US010563601B2

(12) United States Patent
Ahn

(10) Patent No.: US 10,563,601 B2
(45) Date of Patent: Feb. 18, 2020

(54) METHOD FOR CORRECTING DEVIATION OF STATIC FLOW RATES OF GDI INJECTORS AND SYSTEM THEREFOR

(71) Applicants: Hyundai Motor Company, Seoul (KR); Kia Motors Corporation, Seoul (KR)

(72) Inventor: Kyung-Ho Ahn, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/146,604

(22) Filed: Sep. 28, 2018

(65) Prior Publication Data

US 2019/0195154 A1 Jun. 27, 2019

(30) Foreign Application Priority Data

Dec. 27, 2017 (KR) ..... 10-2017-0181249

(51) Int. Cl.
*F02D 41/26* (2006.01)
*F02D 41/00* (2006.01)

(52) U.S. Cl.
CPC ..... *F02D 41/0085* (2013.01); *F02D 41/26* (2013.01); *F02D 2200/0602* (2013.01)

(58) Field of Classification Search
CPC .. F02D 41/0085; F02D 41/26; F02D 41/3818; F02D 41/2467; F02D 2041/389; F02D 2200/0602
USPC ..... 123/457, 435, 299, 300, 510, 511; 701/103; 73/114.16, 114.42, 114.43
See application file for complete search history.

(56) References Cited

U.S. PATENT DOCUMENTS 9,470,170 B2 10/2016 Tanaka

*Primary Examiner* — Hai H Huynh
(74) *Attorney, Agent, or Firm* — Mintz Levin Cohn Ferris Glovsky and Popeo, P.C.; Peter F. Corless

(57) ABSTRACT

A method for correcting a deviation of static flow rates of GDI injectors is provided. The method includes calculating a target pressure drop amount for each cylinder and a relative pressure drop amount for each cylinder from a detected pressure drop amount. An injection correction factor for each cylinder is primarily adjusted by comparing the relative pressure drop amount for each cylinder, with an average of relative pressure drop amounts of all cylinders. The injection correction factor is then secondarily adjusted by comparing an average of injection correction factors of all cylinders with 1.

11 Claims, 2 Drawing Sheets

METHOD FOR CORRECTING DEVIATION OF STATIC FLOW RATES OF GDI INJECTORS AND SYSTEM THEREFOR

CROSS-REFERENCE TO RELATED APPLICATIONS

This application claims priority to Korean Patent Application No. 10-2017-0181249, filed on Dec. 27, 2017, which is incorporated herein by reference in its entirety.

BACKGROUND

Field of the Invention

The present invention relates to a method and a system for correcting a deviation of static flow rates of gasoline direct injection (GDI) injectors and more particularly, to a method and a system for correcting a deviation of static flow rates of GDI injectors, which is intended to correct a deviation of fuel injection amounts between cylinders of a GDI engine.

Description of the Related Art

Gasoline direct injection (GDI) technology has been widely used to improve fuel economy of gasoline engines. However, due to the nature of a direct injection process that generates a substantial amount of particulate substances, the process is subjected to regulations on particle mass (PM) and particle number (PN) at the same level as those in diesel engines.

To be responsive to these regulations, gasoline particle filters (GPFs), a low-pressure exhaust gas recirculation (e.g., low-pressure EGR), a high pressure (e.g., about 350 bar) injection system and the like have been applied to a GDI engine and development of injector hardware and fuel injection control considering a mechanism of formation of particulate substances have been developed. In spite of these efforts, however, it has recently been proved that the PN increases due to a deviation of air-fuel ratios between cylinders due to manufacturing tolerance and coking/aging of injectors. Therefore, measures for solving such problems are required.

SUMMARY

The present invention provides a method and a system for correcting a deviation of static flow rates of GDI injectors, in which a deviation of fuel injection amounts between cylinders of a GDI engine is corrected by adjusting an injection correction factor to generate a relative correction between cylinders.

Other objects and advantages of the present invention may be understood by the following description and become apparent with reference to the exemplary embodiments of the present invention. Also, it is obvious to those skilled in the art to which the present invention pertains that the objects and advantages of the present invention may be realized by the means as claimed and combinations thereof.

In accordance with one aspect of the present invention for accomplishing the object as mentioned above, a method for correcting a deviation of static flow rates of GDI injectors may include: calculating a target pressure drop amount for each cylinder from a fuel compressibility equation; calculating a relative pressure drop amount for each cylinder from a detected pressure drop amount for each cylinder, which is detected in each cylinder by a fuel pressure sensor and the target pressure drop amount for each cylinder, which is calculated in the calculating of a target pressure drop amount; primarily adjusting an injection correction factor for each cylinder by comparing the relative pressure drop amount for each cylinder, which is calculated in the calculating of a relative pressure drop amount, with an average of relative pressure drop amounts of all cylinders; and secondarily adjusting the injection correction factor for each cylinder by comparing an average of injection correction factors of all cylinders, which are primarily adjusted in the adjusting primarily of an injection correction factor, with 1.

In accordance with another aspect of the present invention, a system for correcting a deviation of static flow rates of GDI injectors may include a controller configured to correct static flow rates of injectors in an engine management system (EMS) and the controller may include a learning condition determination unit configured to determine conditions for learning a deviation of static flow rates of injectors, a detection unit configured to detect a pressure drop amount of fuel, and a learning unit configured to learn a deviation of static flow rates of injectors.

The method and system for correcting a deviation of static flow rates of GDI injectors according to the present invention primarily adjust an injection correction factor for each cylinder that is used for correcting a fuel injection amount for each cylinder with a relative value between cylinders that is derived from an average of relative pressure drop amounts of all cylinders and then secondarily adjust the injection correction factor such that an average of the injection correction factors of all cylinders is equal to 1. Therefore, it may be possible to more accurately correct a relative fuel injection amount between cylinders and thus minimize the deviation of the fuel injection amount for each cylinder, thereby contributing to improved stability of combustion and reduction of PN.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

A method and a system for correcting a deviation of static flow rates of GDI injectors according to the present invention will be described below in detail with reference to the accompanying drawings. However, detailed description of functions and constructions well known in the art may be omitted to avoid unnecessarily obscuring the gist of the present invention.

Figure 1:
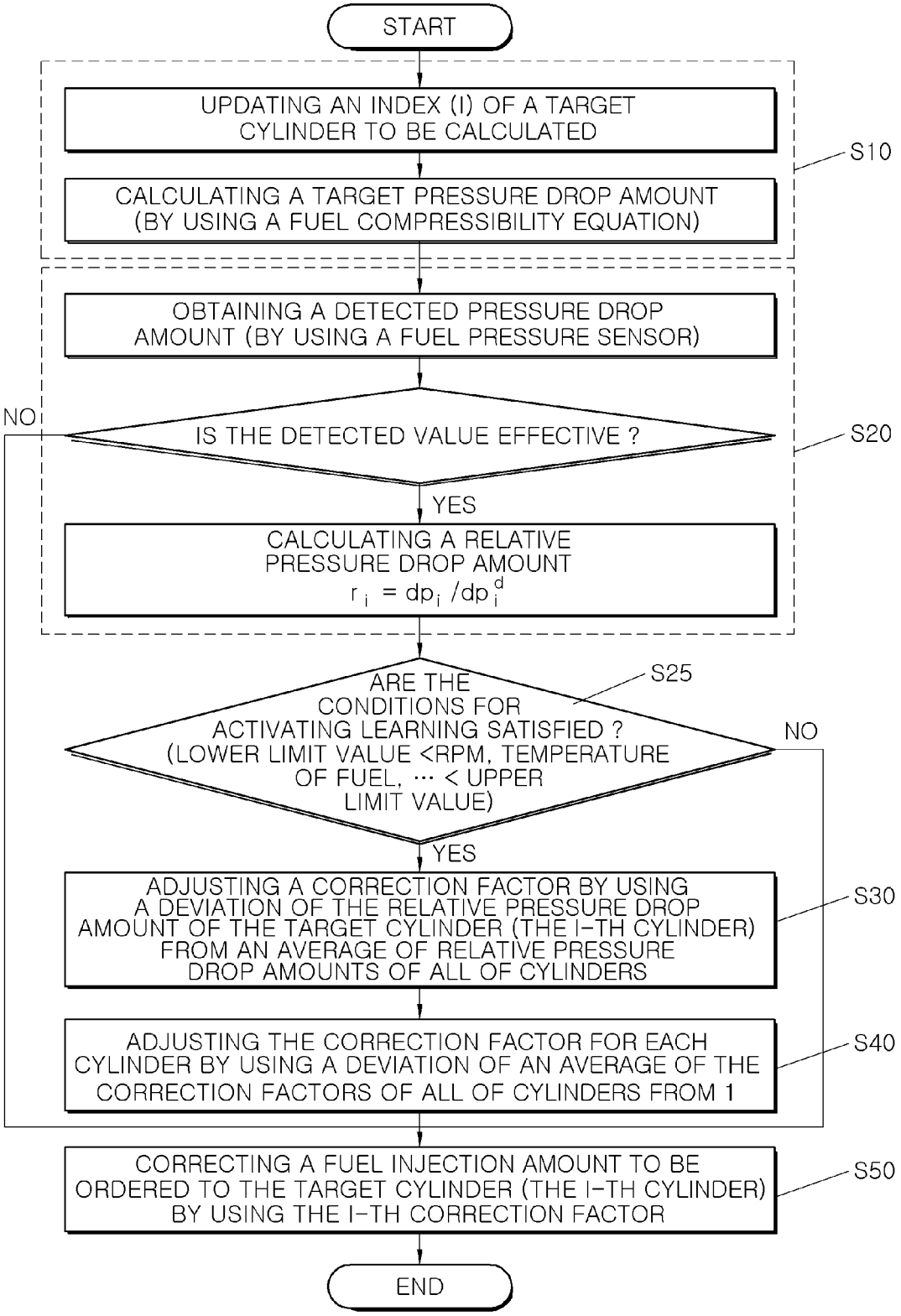
FIG. 1 is a flowchart illustrating processes in a method for correcting a deviation of static flow rates of GDI injectors according to an exemplary embodiment of the present invention.

FIG. 1 is a flowchart illustrating processes in a method for correcting a deviation of static flow rates of GDI injectors according to the present invention. Referring to FIG. 1, the method may include: calculating a target pressure drop amount for each cylinder from a fuel compressibility equation (S10); calculating a relative pressure drop amount for each cylinder from a detected pressure drop amount for each cylinder, which is detected in each cylinder by a fuel pressure sensor and the target pressure drop amount for each cylinder, which is calculated in the calculating of a target pressure drop amount (S20); primarily adjusting an injection correction factor for each cylinder by comparing the relative pressure drop amount for each cylinder, which is calculated in the calculating of a relative pressure drop amount, with an average of relative pressure drop amounts of all cylinders (S30); and secondarily adjusting the injection correction factor for each cylinder by comparing an average of injection correction factors of all cylinders, which are primarily adjusted, with 1 (S40).

In the calculating of a target pressure drop amount, an index i of a target cylinder is updated and a target pressure drop amount for each cylinder ($dp_i^d$) may be calculated by multiplying a pressure drop amount per fuel injection amount, which is obtained by a fuel compressibility equation expressed by the following equation 1, by a target fuel injection amount.

$$\frac{dp}{dm} = \frac{B_S(p, T)}{\rho(p, T) \cdot V} \quad \text{Equation 1}$$

wherein p, T, ρ, and $B_S$ represent pressure of a fuel rail, temperature of fuel, density of fuel and an adiabatic bulk modulus of fuel, respectively and V represents volume of fuel in the fuel rail and the injector.

In the calculating of a relative pressure drop amount, a relative pressure drop amount $r_i$ for each cylinder may be calculated. The relative pressure drop amount is defined as a value obtained by dividing a detected pressure drop amount for each cylinder ($dp_i$) by a target pressure drop amount for each cylinder ($dp_i^d$), which is calculated in the calculating of a target pressure drop amount, as expressed in the following equation 2 wherein, the detected pressure drop amount for each cylinder ($dp_i$) is an effective measurement value obtained from a fuel pressure sensor.

$$r_i = \frac{dp_i}{dp_i^d} \quad \text{Equation 2}$$

In the primary adjustment of an injection correction factor, an injection correction factor $k_i$ for each cylinder may be primarily adjusted by comparing the relative pressure drop amount $r_i$ for each cylinder, which is calculated in the calculating of a relative pressure drop amount, with an average of relative pressure drop amounts of all cylinders, as expressed in the following equation 3.

$$k_i \leftarrow k_i + \gamma\left(\frac{\sum_{m=1}^{n} r_m}{n} - r_i\right) \quad \text{Equation 3}$$

wherein n represents the number of cylinders of an engine and γ represents a gain value that may be appropriately tuned in consideration of transient response damping characteristic and convergence ability.

In the secondary adjustment of an injection correction factor, an injection correction factor $k_j$ for each cylinder may be secondarily adjusted by comparing an average of the injection correction factors $k_i$ of all cylinders, which are primarily adjusted in the primary adjustment of an injection correction factor, with 1, as expressed in the following equation 4.

$$k_j \leftarrow k_j + \alpha\left(1 - \frac{\sum_{m=1}^{n} k_m}{n}\right), \forall j \in \{1, \ldots, n\} \quad \text{Equation 4}$$

wherein n represents the number of cylinders of an engine and α represents a gain value that may be appropriately tuned in consideration of transient response damping characteristic and convergence ability.

As discussed above, the method for correcting a deviation of static flow rates of GDI injectors according to the present invention may primarily adjust an injection correction factor for each cylinder that is used for correcting a fuel injection amount for each cylinder with a relative value between cylinders that is derived from an average of relative pressure drop amounts of all cylinders and then secondarily adjust the injection correction factor such that an average of the injection correction factors of all cylinders is equal to 1. Therefore, it may be possible to correct a relative fuel injection amount between cylinders.

Further, the fuel compressibility equation according to the equation 1 has uncertainty due to a fuel temperature model, property values of fuel and the like. However, the present invention may reduce this uncertainty of the fuel compressibility equation by calculating the injection correction factor with a relative value between cylinders.

Referring to FIG. 1, the reference numeral S25 denotes a process of determining learning conditions where the method for correcting a deviation of static flow rates of GDI injectors according to the present invention may be performed. The reference numeral S50 denotes a process of correcting a fuel injection amount using the injection correction factor finally adjusted in the secondary adjustment of an injection correction factor, S40.

Figure 2:
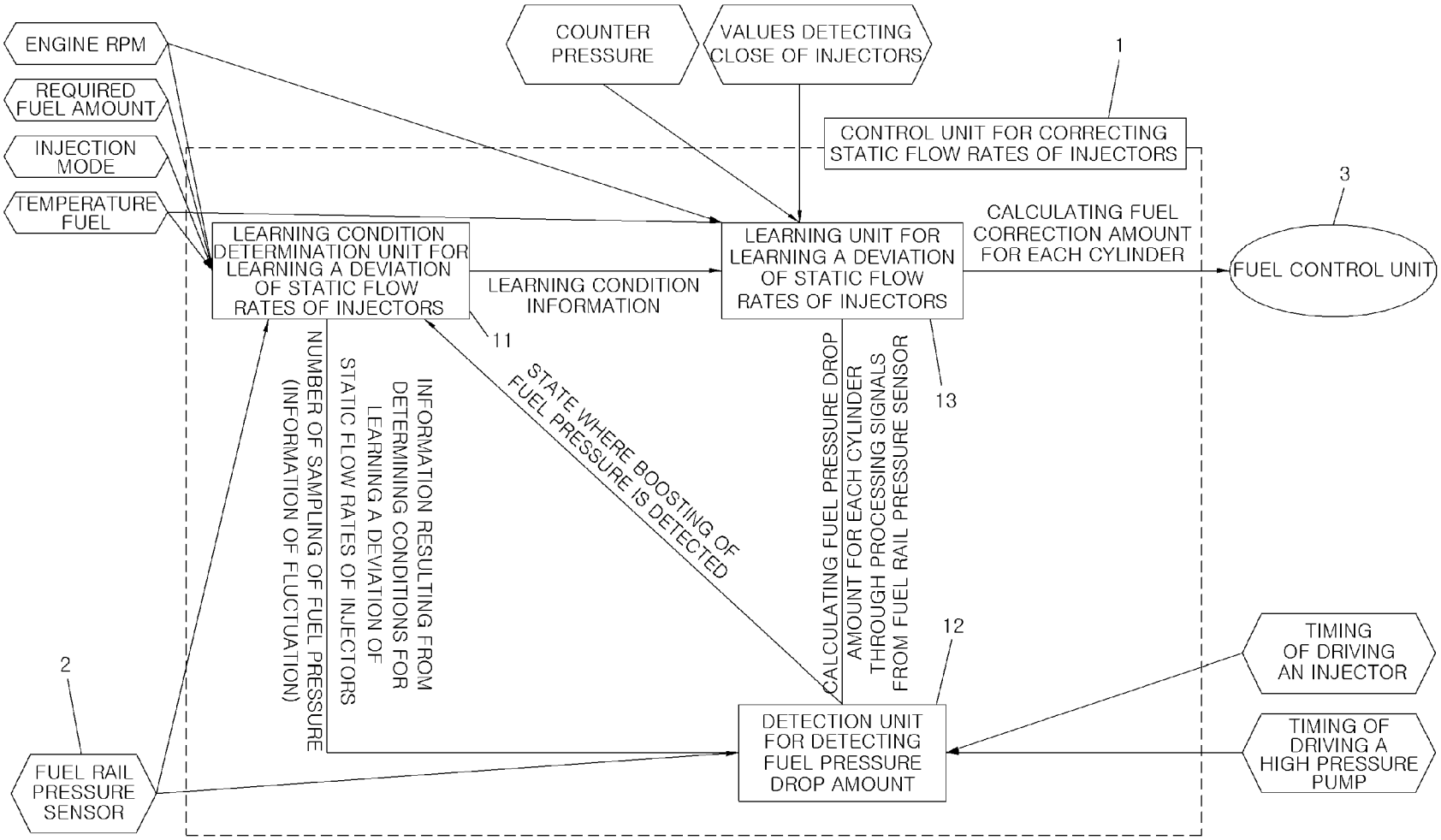
FIG. 2 is a block diagram of a system for correcting a deviation of static flow rates of GDI injectors according to an exemplary embodiment of the present invention.

FIG. 2 is a block diagram of a system for correcting a deviation of static flow rates of GDI injectors according to the present invention. Referring to FIG. 2, a system for correcting a deviation of static flow rates of GDI injectors according to the present invention may include a controller 1 configured to correct static flow rates of injectors in an engine management system (EMS) and then operate the injectors based on the corrected flow rates. In particular, the controller may include a learning condition determination unit 11 configured to determine conditions for learning a deviation of static flow rates of injectors, a detection unit 12 (e.g., a sensor) configured to detect a pressure drop amount of fuel, and a learning unit 13 configured to learn a deviation of static flow rates of injectors. The controller may include a processor and a memory and may be configured to operate the various units thereof.

The learning condition determination unit 11 may be configured to determine whether the conditions in which the method for correcting a deviation of static flow rates of GDI injectors may be performed, that is, whether RPM, temperature of fuel and the like are within an appropriate range (e.g., 500~2200 RPM, −30~90° C.). The learning condition determination unit 11 may then be configured to provide the determined information to the detection unit to detect a fuel pressure drop (e.g., decrease) amount and the learning unit to learn a deviation of static flow rates of injectors.

If the RPM, the temperature of fuel and the like are too low or high (e.g., outside the appropriate range), accuracy of input variables may not be guaranteed. Therefore, the method may not be performed under such conditions (e.g., when the input variables are beyond the appropriate range). Further, the detection unit 12 may be configured to detect pressure drop amount for each cylinder and transmit the detected pressure drop amount for each cylinder to the learning unit 13 to learn a deviation of static flow rates of injectors.

The learning unit 13 may be configured to calculate a relative pressure drop amount by dividing the detected pressure drop amount for each cylinder, which is received from the detection unit 12, by the calculated target pressure drop amount for each cylinder, and then may be configured to primarily adjust the injection correction factor with the relative value between cylinders, which is derived from an average of the calculated relative pressure drop amounts of all cylinders. The learning unit 13 may then be configured to secondarily adjust the injection correction factor such that an average of the injection correction factors of all cylinders is equal to 1, thereby learning the deviation of static flow rates of injectors.

Furthermore, referring to FIG. 2, the reference numeral 3 denotes a fuel controller configured to receive the injection correction factors from the learning unit 13 for learning a deviation of static flow rates of injectors in the controller 1 for correcting a deviation of static flow rates of injectors and may be configured to correct the fuel injection amount and operate the injectors based on the corrected fuel injection amount.

The method and system for correcting a deviation of static flow rates of GDI injectors according to the present invention as described above have improved accuracy of learning, transient response damping characteristic without overshoot or undershoot and rapid convergence ability. The method and system are also capable of being performed while minimizing any influence on other fuel learning routine such as a lambda control. Furthermore, the method and system minimize the deviation of the fuel injection amount for each cylinder, thereby contributing to improved stability of combustion and reduction of PN.

The exemplary embodiments disclosed in the present specification and the accompanying drawings are merely used for the purpose of easily explaining and illustrating the technical idea of the present invention but not limiting the scope of the present invention set forth in the claims. Those skilled in the art will appreciate that various modifications and equivalent other exemplary embodiments can be made without departing from the scope of the present invention.

What is claimed is:

1. A method for correcting a deviation of static flow rates of gasoline direct injection (GDI) injectors, comprising:

calculating, by a controller, a target pressure drop amount for each cylinder from a fuel compressibility equation;

calculating, by the controller, a relative pressure drop amount for each cylinder from a detected pressure drop amount for each cylinder, which is detected in each cylinder by a fuel pressure sensor and the target pressure drop amount for each cylinder;

primarily adjusting, by the controller, an injection correction factor for each cylinder by comparing the relative pressure drop amount for each cylinder with an average of relative pressure drop amounts of all cylinders;

secondarily adjusting, by the controller, the injection correction factor for each cylinder by comparing an average of injection correction factors of all cylinders with 1;

correcting, by the controller, a fuel injection amount between the cylinders based on the secondarily adjusted injection correction factor; and operating, by the controller, the GDI injectors based on the fuel injection amount.

2. The method according to claim 1, wherein the target pressure drop amount for each cylinder is calculated by multiplying a pressure drop amount per fuel injection amount, which is obtained by a fuel compressibility equation, by a target fuel injection amount.

3. The method according to claim 2, wherein in the calculating a relative pressure drop amount, a relative pressure drop amount for each cylinder is calculated, the relative pressure drop amount being defined as a value obtained by dividing a detected pressure drop amount for each cylinder by the target pressure drop amount for each.

4. The method according to claim 3, wherein the injection correction factor for each cylinder is primarily adjusted by comparing the relative pressure drop amount for each cylinder with an average of relative pressure drop amounts of all cylinders.

5. The method according to claim 4, wherein the injection correction factor for each cylinder is secondarily adjusted by comparing an average of the injection correction factors of all cylinders with 1.

6. A system for implementing the method for correcting a deviation of static flow rates of gasoline direct injection (GDI) injectors according to claim 1, comprising:

a controller configured to correct static flow rates of injectors in an engine management system (EMS), wherein the controller is configured to determine conditions for learning a deviation of static flow rates of injectors, detect a pressure drop amount of fuel, and learn a deviation of static flow rates of injectors.

7. The system according to claim 6, wherein the controller is configured to determine conditions in which learning a deviation of static flow rates of injectors is possible to detect a fuel pressure drop amount and learn a deviation of static flow rates of injectors.

8. The system according to claim 6, wherein the controller is configured to detect a fuel pressure drop amount using a signal from a fuel pressure sensor and detect a pressure drop amount for each cylinder to learn a deviation of static flow rates of injectors.

9. The system according to claim 8, wherein the controller is configured to:

calculate a relative pressure drop amount by dividing the detected pressure drop amount for each cylinder by the target pressure drop amount for each cylinder, which is calculated by using a fuel compressibility equation;

primarily adjust the injection correction factor with a relative value between cylinders, which is derived from an average of the calculated relative pressure drop amounts of all cylinders; and secondarily adjust the injection correction factor such that an average of the injection correction factors of all cylinders is equal to 1 to learn the deviation of static flow rates of injectors.

10. The system of claim 9, wherein the controller is configured to correct a fuel injection amount between the cylinders based on the secondarily adjusted injection correction factor; and operate the GDI injectors based on the fuel injection amount.

11. A method for correcting a deviation of static flow rates of gasoline direct injection (GDI) injectors, comprising:

primarily adjusting, by a controller, an injection correction factor for each cylinder that is used for correcting a fuel injection amount for each cylinder with a relative value between cylinders that is derived from an average of relative pressure drop amounts $r_i$ of all cylinders, the relative pressure drop amount being defined as the following equation:

$$r_i = \frac{dp_i}{dp_i^d}$$

wherein $dp_i$ represents a detected pressure drop amount for each cylinder, which is detected by a fuel pressure sensor, and $dp_i^d$ represents a target pressure drop amount for each cylinder, which is calculated from a fuel compressibility equation; and secondarily adjusting, by the controller, the injection correction factor such that an average of the injection correction factors of all cylinders is equal to 1 to correct a relative fuel injection amount between cylinders.

* * * * *